US008343322B2

(12) United States Patent
Wahl et al.

(10) Patent No.: US 8,343,322 B2
(45) Date of Patent: Jan. 1, 2013

(54) GAS SENSOR FOR MEASURING A GAS COMPONENT IN A GAS MIXTURE

(75) Inventors: Thomas Wahl, Pforzheim (DE); Bernd Schumann, Rutesheim (DE); Sabine Thiemann-Handler, Stuttgart (DE); Berndt Cramer, Leonberg (DE); Helge Schichlein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 401 days.

(21) Appl. No.: 12/529,870

(22) PCT Filed: Jan. 28, 2008

(86) PCT No.: PCT/EP2008/050933

§ 371 (c)(1),
(2), (4) Date: Feb. 25, 2010

(87) PCT Pub. No.: WO2008/107229

PCT Pub. Date: Sep. 12, 2008

(65) Prior Publication Data

US 2010/0230297 A1 Sep. 16, 2010

(30) Foreign Application Priority Data

Mar. 7, 2007 (DE) ..... 10 2007 011 049

(51) Int. Cl.
*G01N 27/26* (2006.01)

(52) U.S. Cl. ..... 204/424; 204/406

(58) Field of Classification Search ..... 205/781, 205/785, 780; 204/431, 424, 421
See application file for complete search history.

(56) References Cited

U.S. PATENT DOCUMENTS

| | | | | |
|---|---|---|---|---|
| 5,928,494 | A * | 7/1999 | Kato et al. | 205/781 |
| 6,482,650 | B1 * | 11/2002 | Kato et al. | 436/37 |
| 6,818,111 | B1 | 11/2004 | Lenfers et al. | |
| 2003/0075441 | A1 | 4/2003 | Ketterle et al. | |
| 2004/0238378 | A1 | 12/2004 | Kumazawa et al. | |

FOREIGN PATENT DOCUMENTS

| | | |
|---|---|---|
| DE | 19840888 | 3/2000 |
| DE | 10100599 | 7/2002 |
| EP | 0930501 | 7/1999 |
| EP | 0987546 | 3/2000 |

OTHER PUBLICATIONS

International Search Report, PCT International Patent Application No. PCT/EP2008/050933, dated May 13, 2008.

* cited by examiner

*Primary Examiner* — Jeffrey T Barton
*Assistant Examiner* — Louis Rufo
(74) *Attorney, Agent, or Firm* — Kenyon & Kenyon LLP

(57) ABSTRACT

A ceramic gas sensor for measuring a gas component in a gas mixture, which includes a sensor element, which has at least one first electrode exposed to the gas mixture to be determined, and at least one further electrode. Only one shared electrical contact is provided for the first electrode and for the additional electrode, an electrical resistor, which is situated inside the gas sensor, being preconnected to the first electrode and/or the additional electrode.

12 Claims, 3 Drawing Sheets

GAS SENSOR FOR MEASURING A GAS COMPONENT IN A GAS MIXTURE

FIELD OF THE INVENTION

The present invention relates to a gas sensor for measuring a gas component in a gas mixture, and to its use.

BACKGROUND INFORMATION

In the course of progressive environmental legislation there is growing demand for sensors with whose aid even the minutest quantities of pollutants can be reliably determined. Above all, gas sensors that allow the determination of gaseous pollutants in the ppm range, independent of the temperature of the measuring gas, play an important role. However, especially the determination of the nitrogen oxide content in the combustion waste gases poses a special challenge because of the frequently high oxygen component in exhaust gases.

U.S. Application No. 2003/0075441 describes, for instance, a gas sensor which, among other things, is used to determine nitrogen oxides. Its method of functioning is assignable to what is known as the dual-chamber limit current principle. Measuring gas that enters the sensor is selectively rid of oxygen with the aid of two electrochemical pump cells situated one after the other in the flow direction of the measuring gas, and the partial pressure of the oxygen is therefore reduced considerably in this manner. The individual pump electrodes have different potentials, so that the oxygen content of the measuring gas can be reduced in a stepwise manner without changing the nitrogen oxide component in the measuring gas to any significant degree.

However, this sensor structure requires a multitude of electrical connections for contacting pump electrodes, measuring electrodes, heating elements etc. A high number of connections, however, leads to considerable expense with regard to routing the electrical feeds out of the sensor element, the electrical contacting and routing the cables out of the sensor housing. This results in high material and production expense and an increased quality risk.

SUMMARY

It is an object of the present invention to provide a gas sensor, which, among other things, permits the determination of nitrogen oxides in combustion exhaust gases and simultaneously uses a low number of required electrical contacts.

An example gas sensor according to the present invention may achieve this object. The example gas sensor includes a sensor element, and two electrodes of the sensor element have a shared electrical contact. In this way the complex separate contacting of one of the two electrodes is able to be dispensed with. To make it possible to realize different potentials at the individual electrodes nevertheless, an electric resistor is preconnected to at least one of the electrodes.

It may be especially advantageous if both electrodes are developed as pump electrodes in order to vary the oxygen concentration at or within the sensor element, since relatively static, different pump voltages are applied here, whose intensity is easy to calculate.

Furthermore, it may be advantageous if the electric resistor is integrated in a ceramic layer plane of the sensor element in which the first or the second electrode is developed. The contacting of the electrodes or the integration of the electrical resistor into the electrode supply lead of at least one of the electrodes is therefore able to be implemented in a simple manner from the standpoint of production technology. As an alternative, the electrical resistor may be situated on a large surface of the sensor element. This, too, may constitute a satisfactory solution from the aspect of production technology.

It may be especially advantageous if the gas sensor actually has only one shared electrical contact for the first electrode and for the further electrode, and if this electrode supply lead branches even before entering the sensor element of the gas sensor, and the sensor element has a first electrode supply lead for the first electrode and a second electrode supply lead for the second electrode. The electrical resistor is then assigned to at least one of the electrode supply leads inside the gas sensor and must therefore not be integrated in the sensor element in the production.

Moreover, it may be especially advantageous if the electric resistor is made from a metal alloy. If suitable alloys of a platinum metal and/or a coinage metal are used, then the electrical resistor exhibits only a slight thermal dependency of its Ohmic resistance. In this way temperature-stable potentials are able to be realized at the corresponding electrodes.

BRIEF DESCRIPTION OF THE DRAWINGS

The present invention is explained in greater detail below.

DETAILED DESCRIPTION OF EXAMPLE EMBODIMENTS

Figure 1:
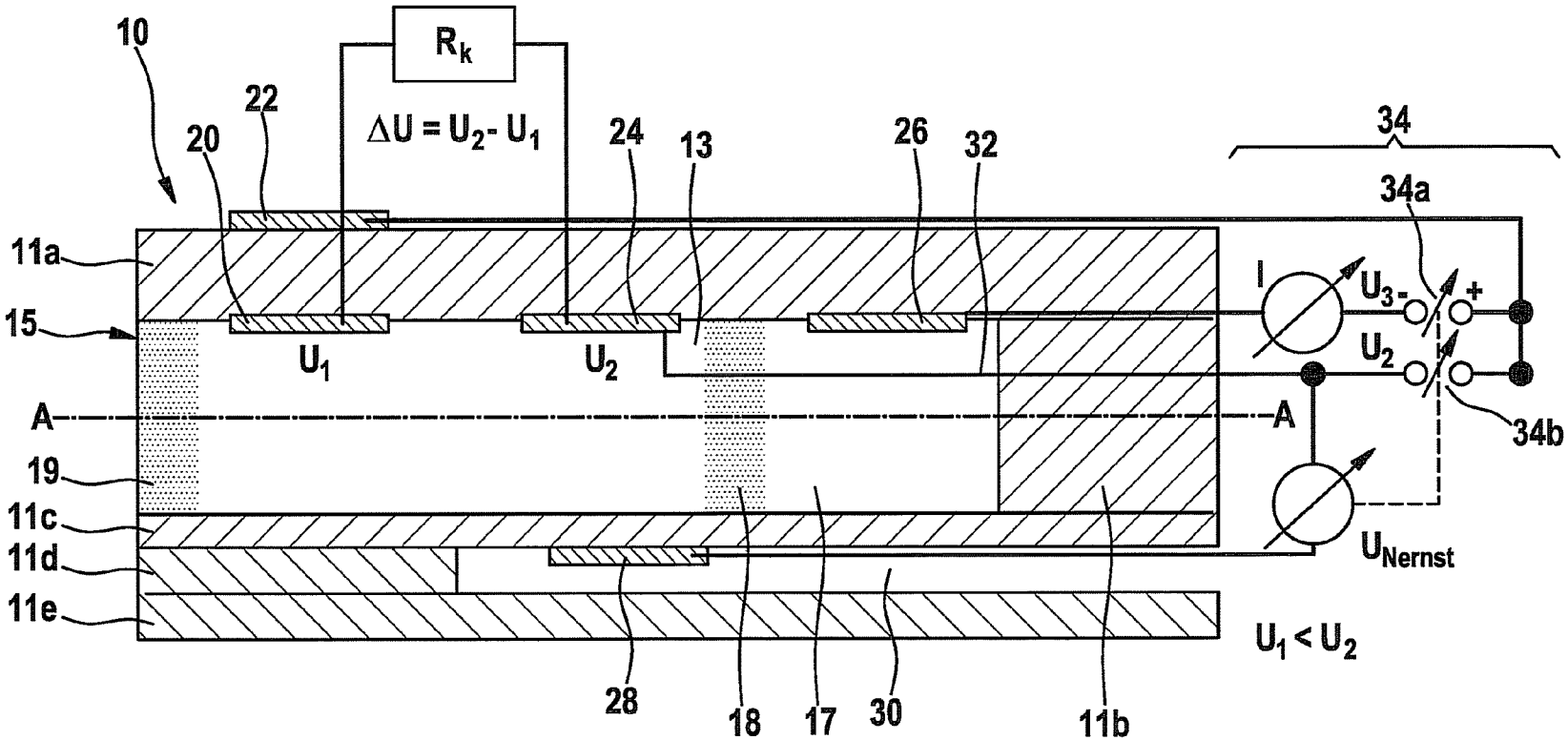
FIG. 1 shows a schematic longitudinal section through the sensor element of a gas sensor according to a first exemplary embodiment.
Figure 2:
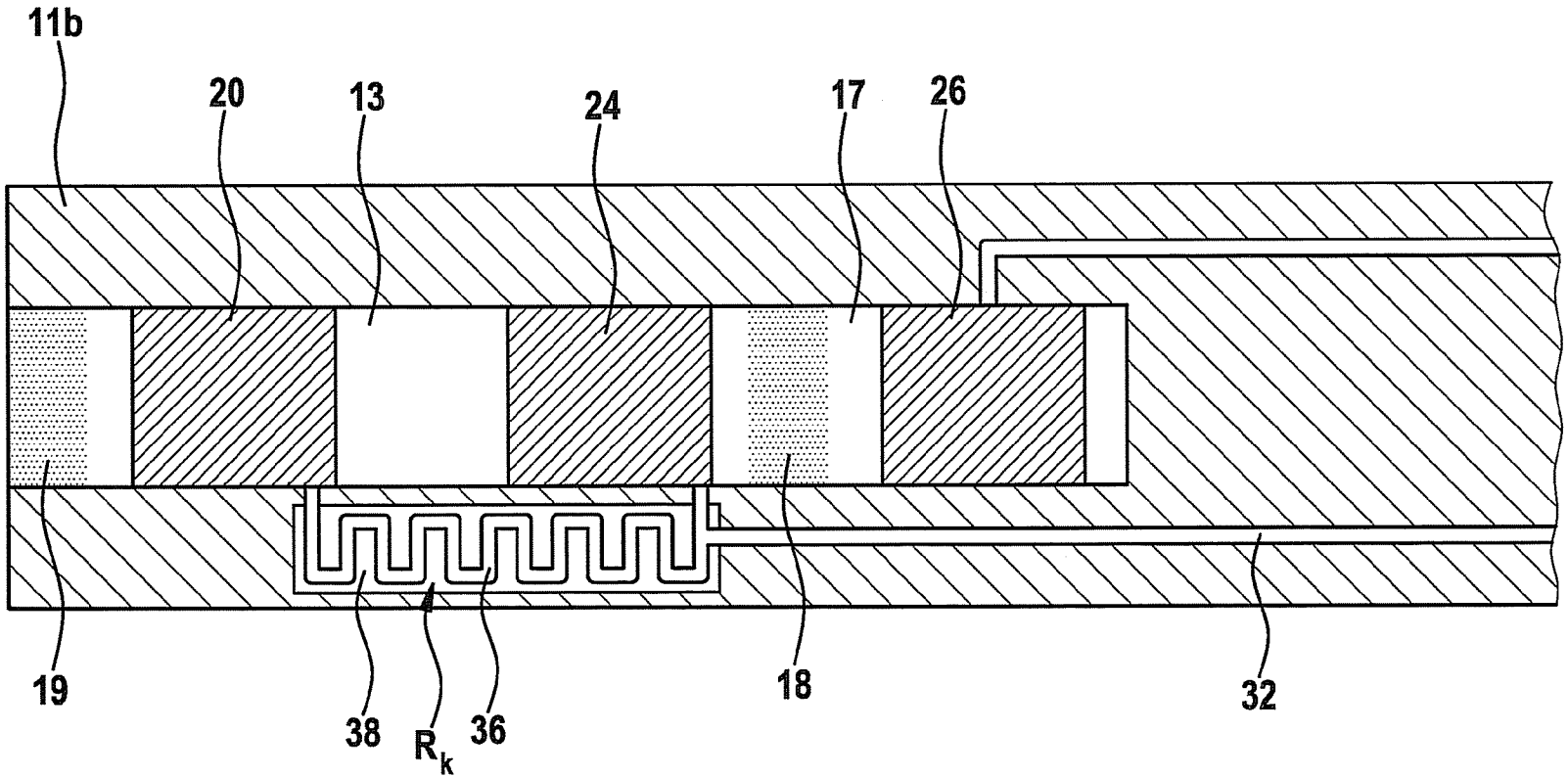
FIG. 2 shows a cross section of the sensor element shown in FIG. 1, along the cutting line A-A.
Figure 3:
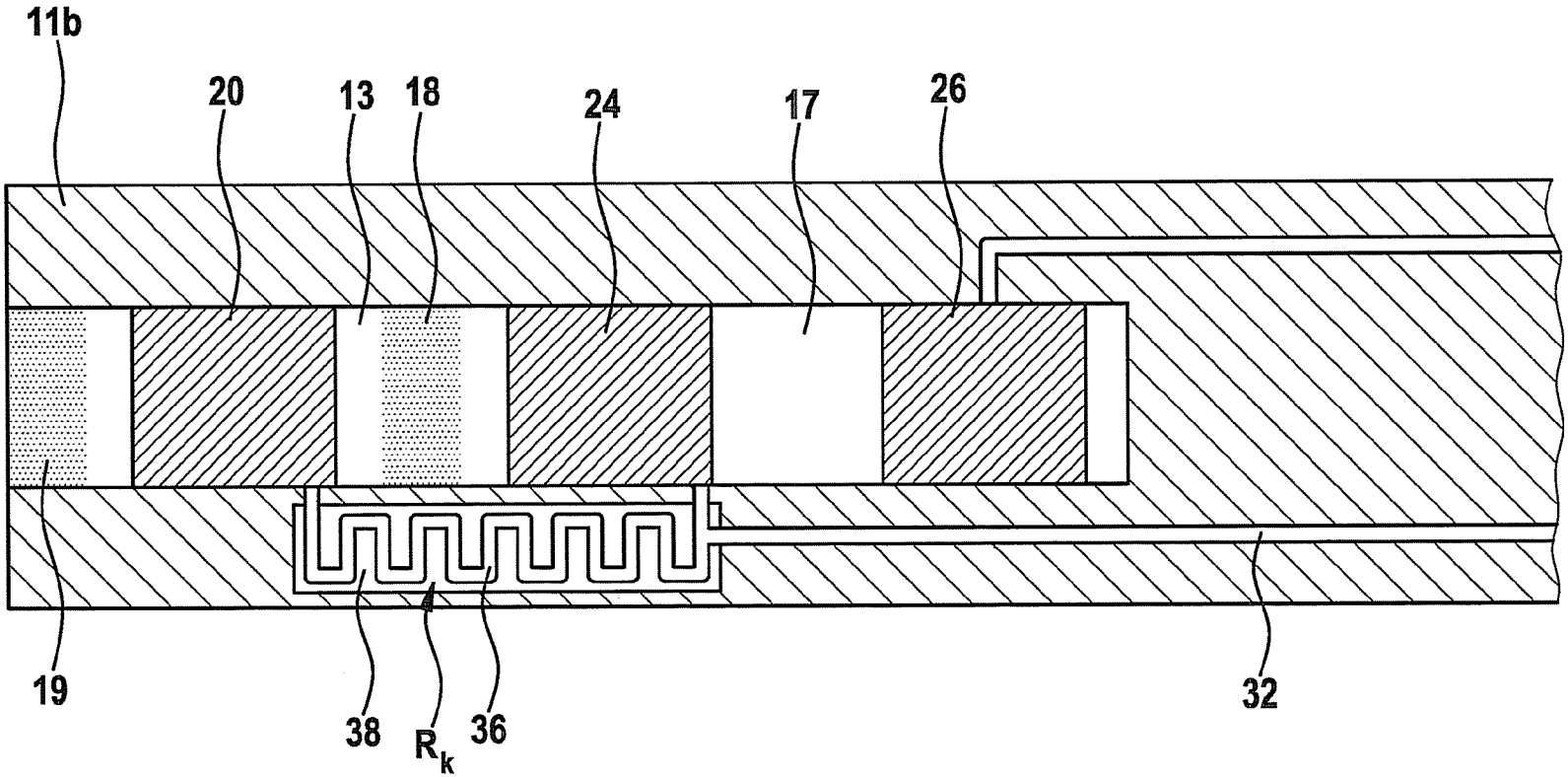
FIG. 3 shows a cross section of a sensor element according to a second exemplary embodiment, along the cutting line A-A.

Unless noted otherwise, the reference numerals used in FIGS. 1 through 3 refer to structural components of a sensor element having equivalent functions.

FIG. 1 shows a basic design of a first specific embodiment according to the present invention. Denoted by 10 is a planar sensor element of an electrochemical gas sensor, which, for example, has a plurality of solid electrolyte layers 11*a*, 11*b*, 11*c*, 11*d* and 11*e* which conduct oxygen ions. Solid electrolyte layers 11*a*, 11*c*, and 11*e* are implemented as ceramic foils and form a planar ceramic body. The integrated form of the planar ceramic body of sensor element 10 is produced in a manner known per se, by laminating together the ceramic foils printed over with functional layers and subsequently sintering the laminated structure. Each solid electrolyte layer 11*a* through 11*e* is made of solid electrolyte material that conducts oxygen ions, such as $ZrO_2$ stabilized partially or fully with $Y_20_3$. Solid electrolyte layers 11*a*-11*e* alternatively may be at least partially replaced by foils made of aluminum oxide, at locations where ion conduction in the solid electrolyte is not important or even undesired.

Sensor element 10 includes a measuring gas chamber 13, preferably in the layer plane of ceramic layer 11*b*, which measuring gas chamber is in contact with a gas mixture surrounding the gas sensor via a gas entry opening 15. A diffusion barrier 19 of a porous ceramic material, for example, is situated between gas entry opening 15 and measuring gas chamber 13 in the diffusion direction of the measuring gas, so that the gas entry into measuring gas chamber 13 is limited as a result of the porous structure of diffusion barrier 19.

In a further layer plane of ceramic layer 11*d* of the sensor element, a reference gas channel 30 is formed, which contains a reference gas atmosphere. The reference gas atmosphere may be air, for example. For this purpose, reference gas channel 30 is provided with an opening, not shown, on a side of the sensor element facing away from the measuring gas, which ensures the gas exchange with the surrounding air.

Furthermore, a resistor heating element, which is not shown here, is preferably embedded in the ceramic base element of sensor element 10. The resistor heating element is used for heating sensor element 10 to the required operating temperature.

A first inner electrode 20 and a second inner electrode 24 are provided in first measuring gas chamber 13 in the diffusion direction of the measuring gas. They are preferably made of a platinum-gold alloy. On the outer side of solid electrolyte layer 11*a* directly facing the gas mixture, there is an outer electrode 22, which may be covered by a porous protective layer (not shown). Electrodes 20, 22 or 24, 22 form a first and a second electrochemical pump cell. The operating mode as pump cell includes an application of a voltage between electrodes 20, 22 or 24, 22 of the pump cells, which results in an ion transport between electrodes 20, 22 or 24, 22 all the way through solid electrolyte 11*a*. The number of "pumped" ions is directly proportional to a pump current flowing between electrodes 20, 22 or 24, 22 of the pump cell.

If it is to be assumed that the gas mixture present has only a low oxygen component, then it is possible to dispense with first inner electrode 20 and consequently with first electrochemical pump cell 20, 22 as well. This is the case, for example, with exhaust gases of motor vehicles that are constantly operated at a lambda value=1. This simplifies the sensor construction.

To operate sensor element 10 as gas sensor, first pump cell 20, 22 and second pump cell 24, 22 are selectively utilized to regulate the oxygen component of the gas mixture diffused into measuring gas chamber 13. A constant partial pressure of the oxygen of 0.1 through 1000 ppm, for instance, is set in measuring gas chamber 13 by pumping oxygen in or out. If possible, a decomposition of nitrogen or sulfur oxides should not occur despite their similar electrochemical behaviors.

To this end, inner electrodes 20, 24 have different electric potentials. For instance, first inner electrode 20 has a cathodic potential that is lower in its amount, whereas second inner electrode 24 has a higher cathodic potential. This ensures that a large share of the oxygen contained in the gas mixture is removed in the region of first inner electrode 20, the relatively low electric potential of first inner electrode 20 making it possible to limit the component of removed nitrogen oxides to a minimum. At second inner electrode 24, which is post-connected to first inner electrode 20 in the flow direction of the gas mixture, oxygen still remaining in the gas mixture is reduced as a result of the higher cathodic potential applied there, and a change in the concentration of nitrogen oxides or sulfur oxides in the gas mixture is avoided there as well. Therefore, a potential difference is generally provided between first and second inner electrode 20, 24, which is able to be set as a function of the remaining oxygen content in the gas mixture. In the case of a high partial pressure of oxygen in the gas mixture, for example, a relatively high potential difference may be required between first and second pump electrode 20, 24.

Furthermore, sensor element 10 has an additional measuring gas chamber 17, which is formed preferably in the same layer plane as measuring gas chamber 13 and separated from first measuring gas chamber 13 by an additional diffusion barrier 18. An additional inner electrode 26 is provided inside the chamber, which, together with outer electrode 22 or alternatively with reference electrode 28, forms an additional electrochemical pump cell 22, 26 or 28, 26. Further inner electrode 26 is preferably developed from a catalytically active material such as platinum, for instance, or an alloy of a plurality of platinum metals. The electrode material for all electrodes is realized as cermet, in a conventional manner, for sintering with the ceramic foils of the sensor element.

The gas mixture, largely freed of oxygen with the aid of the first and second electrochemical pump cell, flows through additional diffusion barrier 18 into additional measuring gas chamber 17. There, the nitrogen oxides or sulfur oxides contained in the gas mixture are electrochemically reduced due to a cathodic potential applied at additional inner electrode 26, and the oxygen ions produced at additional inner electrode 26 are transported to outer electrode 22 or to reference electrode 26 and oxidized there. The nitrogen produced in this process as well, diffuses out of the sensor element. The pump current at the third pump cell, formed by additional inner electrode 26 and outer electrode 22 or reference electrode 28, is used to determine the concentration of nitrogen oxides and/or sulfur oxides since, conditioned upon the method, it responds proportionally to the nitrogen oxide concentration or the sulfur oxide concentration in the gas mixture. Furthermore, the oxygen pump flow of the first or second pump cell 20, 22 or 24, 22 is able to be utilized in comparable manner for determining the oxygen concentration in the gas mixture.

The control of the partial pressure of the oxygen in measuring gas chamber 13 preferably takes place with the aid of an additional concentration cell provided in the sensor element. Preferably, reference electrode 28 together with second inner electrode 24 is switched as electrochemical Nernst or concentration cell for this purpose. A Nernst cell or a concentration cell is generally understood to be a dual-electrode system in which the two electrodes 24, 28 are exposed to different gas concentrations, and a difference in the potentials applied at electrodes 24, 28 is measured. According to the Nernst equation, this potential difference permits an inference regarding the oxygen concentrations present at electrodes 24, 28. The pump voltage at the first and/or second pump cell 20, 22 or 24, 22 is varied in such a way that a constant potential difference comes about between electrodes 20, 28 of the concentration cell.

As an alternative, the pump potential applied at first or second inner electrode 20, 24 is able to be adjusted by determining the Nernst potential difference between second inner electrode 24 and reference electrode 28. A further alternative consists of providing a separate, additional inner electrode inside first measuring gas chamber 13, the electrode being developed as Nernst electrode, for determining the oxygen concentration. Preferably, it is positioned in the area of second diffusion barrier 18 and forms an electrochemical concentration cell together with reference electrode 28. The additional inner electrode developed as Nernst electrode may also be disposed inside second measuring gas chamber 17 or in front of further inner electrode 26 in the flow direction.

Because of the existence of a multitude of electrodes and the integrated heating element, a multitude of electrical connections is required first of all. However, a high number of connections results in high expense in connection with routing the electrical lines out of the sensor element, the electrical contacting of the same in the associated gas sensor, and also with routing the cables out of the sensor housing of the gas sensor.

In order to reduce the number of required electrical connections, first inner electrode 20 and second inner electrode 24 are contacted via a shared electrode supply lead 32. In order to achieve different potentials at inner electrodes 20, 24 nevertheless, electrode supply lead 32 includes an electrical resistor $R_k$ in its region connecting the first to the second inner electrode, the resistor being schematically illustrated in FIG. 1. In this way a portion of the voltage applied at electrode supply lead 32 drops at resistor $R_k$, so that second inner electrode 24 exhibits the applied potential, but first inner electrode 20 has a deviating potential that is relatively low compared to the potential applied at second inner electrode 24. The potential to be applied is adjusted via a corresponding sensor evaluation circuit 34, shown only schematically in FIG. 1, which has voltage sources 34*a*, 34*b* as well as signal acquisitions for current intensity I and voltage $U_{Nernst}$.

A first form of electrical contact of first and second inner electrode 20, 24 is illustrated in FIG. 2. Electrode supply lead 32, for instance, has a branching point in the region of second inner electrode 24, second inner electrode 24 being contacted with the aid of a first branch of the branching point, and a second branch of the branching point having the electrical resistor $R_k$ and contacting first inner electrode 20. Electrical resistor $R_k$ is preferably implemented with the aid of thick-film technology and integrated into the ceramic material of solid electrolyte layer 11*b*. It includes a resistor track 36 and preferably also a ceramic insulation 38, for instance from aluminum oxide, so as to avoid shunt firing. Electrical resistor $R_k$ implemented as thick film resistor includes as resistor track 36 a binary or ternary metal alloy, for instance. Alloys of noble metals of the platinum metal group such as Ru, Rh, Pd, Ir or Pt as well as of the coinage metal group such as Au or Ag are preferably considered. The material of resistor track 36 also includes ceramic components with a share of more than 2 volume %. The Ohmic resistance of the resulting electrical resistor $R_k$ lies in the range from 2 to 300Ω at the operating temperature of the sensor element, preferably in the range from 10 to 200Ω. The operating temperature of the sensor element lies within a range from 650° C. to 950° C.

However, the present specific embodiment is not restricted to the integration of electrical resistor $R_k$ into layer plane 11*b*, which also includes inner electrodes 20, 24, 26. Instead, a corresponding electrical resistor $R_k$ may be disposed at any other position within sensor element 10, for instance also in one of the measuring gas chambers 13, 17, or on one of the outer surfaces of sensor element 10.

Furthermore, as an alternative, electrical resistor $R_k$ may indeed be provided within a housing of the gas sensor, but outside of the sensor element. Although the gas sensor actually does have a shared contact for first and second inner electrode 20, 24, the corresponding electrode supply lead branches within the housing of the gas sensor outside of sensor element 10, so that sensor element 10 has a separate electrode supply lead for each inner electrode 20, 24 in this case, of which at least one includes a resistor $R_k$.

In order to ensure the most uniform resistance of electrical resistor $R_k$ with a low temperature dependency, electrical resistor $R_k$ implemented as thick film resistor is preferably made of a material that has a low thermal coefficient of resistance.

However, if a certain variability of the potential difference applied between the first and second inner electrode is provided, then it is alternatively possible to implement the resistor from a PTC or NTC material. This would have the advantage that in an intervention in a temperature control or temperature regulation of the sensor element, for instance within a temperature window of ±50° C., resistor $R_k$, given the use of a PTC or NTC resistor, would allow a desired higher or lower potential difference between first and second inner electrode 20, 24, since a change in the sensor temperature would be accompanied by a corresponding change in the electrical resistance of resistor $R_k$.

A further alternative development of the described sensor element of the gas sensor is shown in FIG. 3. Second inner electrode 24 is not disposed inside first measuring gas chamber 13 but inside second measuring gas chamber 17. This has the advantage that the regulation of the oxygen pump flow takes place in accordance with the partial pressure of the oxygen prevailing in the measuring gas, to which additional inner electrode 26 is exposed as well.

Furthermore, the present invention is not limited to a joint contact of first and second inner electrode 20, 24, respectively. Especially when largely constant potential differentials are to be applied between first or second inner electrode on the one hand, and additional inner electrode 26 on the other, further inner electrode 26 is able to be contacted jointly with first and/or second inner electrode 20, 24 while integrating a plurality of electrical resistors $R_k$, with the aid of a shared electrode supply lead, so that all electrodes of the sensor element that come into contact with the gas mixture have common contacts. In addition, all jointly contacted electrodes may be assigned an individual electrical resistor $R_k$, whose Ohmic resistance is of different magnitude in each case.

The use of a gas sensor having sensor element 10 is not limited to determining nitrogen oxides or sulfur oxides. In general, it is possible to use third pump cell 26, 22 to determine gas components of the gas mixture amperometrically, either by electrochemical reduction or oxidation given a suitable selection of the pump voltage applied at third pump cell 26, 22. Reducible gas components are able to be determined in the first case, and oxidizable components, such as ammonia, hydrocarbons or hydrogen, in the second case. Since the pump voltage applied at electrodes 26, 22 may also be varied for a short period of time, it is also possible to determine one or more reducing or oxidizing gas components, either periodically or sequentially at short time intervals in alternation, using a gas sensor.

What is claimed is:

1. A ceramic gas sensor for measuring a gas component in a gas mixture, comprising:

a sensor element, which includes at least one first electrode exposed to the gas mixture to be determined, and at least one further electrode exposed to the gas mixture to be determined;

wherein only one shared electrical contact is provided for the first electrode and the at least one further electrode, and wherein an electrical resistor, which is situated inside the gas sensor, is serially preconnected to at least one of the first electrode and the at least one further electrode.

2. The gas sensor as recited in claim 1, wherein the first electrode and the at least one further electrode are pump electrodes for varying oxygen concentration at or within the sensor element.

3. The gas sensor as recited in claim 2, wherein different pump voltages are applied at the first electrode and at the at least one further electrode.

4. The gas sensor as recited in claim 3, wherein the sensor element is developed from ceramic layers, and the electrical resistor is developed in a same ceramic layer plane as at least one of the first electrode and the at least one further electrode.

5. The gas sensor as recited in claim 1, wherein the electrical resistor is developed on an outer surface of the sensor element.

6. The gas sensor as recited in claim 1, wherein the sensor element has within the gas sensor a first electrode supply lead for the first electrode, and a second electrode supply lead for the at least one further electrode.

7. The gas sensor as recited in claim 1, wherein the electrical resistor has a resistor track made of a metal alloy.

8. The gas sensor as recited in claim 7, wherein the resistor track is made of an alloy of at least one of a platinum metal and a coinage metal.

9. The gas sensor as recited in claim 8, wherein the resistor track includes a ceramic component at a share of at least 2 vol. %.

10. The gas sensor as recited in claim 9, wherein the resistor track is at least partially surrounded by a layer made of an insulating material.

11. The gas sensor as recited in claim 1, wherein the electrical resistor has an Ohmic resistance of 2 to 300Ω at a temperature of 650 to 950° C.

12. A method of using a gas sensor, comprising:

providing a ceramic gas sensor, including a sensor element, which includes at least one first electrode exposed to the gas mixture to be determined, and at least one further electrode exposed to the gas mixture to be determined, wherein only one shared electrical contact is provided for the first electrode and the at least one further electrode, and wherein an electrical resistor, which is situated inside the gas sensor, is serially preconnected to at least one of the first electrode and the at least one further electrode; and using the gas sensor to determine at least one of a nitrogen oxide, sulfur oxide, and ammonia in combustion exhaust gases.

* * * * *